US005786312A

United States Patent [19]

Post et al.

[11] Patent Number: 5,786,312

[45] Date of Patent: Jul. 28, 1998

[54] BAR COMPOSITION COMPRISING COPOLYMER MILDNESS ACTIVES

[75] Inventors: Albert Joseph Post, Teaneck; Edward Van Gunst, Little Ferry; Mengtao He, Wayne; Michael Fair, Hackensack, all of N.J.; Michael Massaro, Congers, N.Y.

[73] Assignee: Lever Brothers Company, Division of Conopco, Inc., New York, N.Y.

[21] Appl. No.: 662,394

[22] Filed: Jun. 12, 1996

[51] Int. Cl.[6] ..... C11D 9/30

[52] U.S. Cl. ..... 510/152; 510/153; 510/440; 510/447; 510/481; 510/505

[58] Field of Search ..... 510/152, 153, 510/440, 447, 481, 505

[56] References Cited

U.S. PATENT DOCUMENTS

| | | | |
|---|---|---|---|
| 3,312,627 | 4/1967 | Hooker . | |
| 3,766,097 | 10/1973 | Rosmarin . | |
| 4,874,538 | 10/1989 | Dawson et al. | 510/153 |
| 4,985,170 | 1/1991 | Dawson et al. | 510/152 |
| 5,520,840 | 5/1996 | Massaro et al. | 510/153 |
| 5,605,681 | 2/1997 | Trandai et al. | 424/65 |

FOREIGN PATENT DOCUMENTS

| | | |
|---|---|---|
| 2243615 | 6/1991 | United Kingdom . |

*Primary Examiner*—Jacqueline V. Howard
*Assistant Examiner*—Cephia D. Toomer
*Attorney, Agent, or Firm*—Ronald A. Koatz

[57] ABSTRACT

The present invention is directed to mixed fatty acid soap based bar compositions, which may include synthetic surfactants as co-actives, wherein relatively small amounts of specified polyoxyethylene-polypropylene nonionic polymer has been found to enhance mildness and reduced mush of bar compositions without sacrificing the user properties and processability of the formulations.

9 Claims, 1 Drawing Sheet

BAR COMPOSITION COMPRISING COPOLYMER MILDNESS ACTIVES

FIELD OF THE INVENTION

The present invention relates to fatty acid soap bar compositions (i.e., bars in which fatty acid soaps are used as the primary detergent, and synthetic surfactants, such as anionic surfactants and amphoteric surfactants, are used as co-surfactants).

BACKGROUND

Soap has traditionally been used as a skin cleanser. It has many advantages (e.g., inexpensive, easy to manufacture into bars, having good lathering properties), but it can irritate the skin due to its harsh nature. A number of strategies have been developed in the art to amelioriate the harshness of soap cleansing bars.

One approach is to replace some or all of the soap with a synthetic surfactant. The use of synthetic surfactants can introduce other problems. For example, anionic surfactants may still be harsh. Non-ionic surfactants generally do not generate creamy thick lather as do soap or anionic surfactants. Both non-ionics and amphoterics can be sticky and lead to difficulty in standard processing steps such as extrusion or stamping.

Another approach to reduce the harshness of personal cleansing bars is to dilute the cleansing agents of the bar formulation with a filler or inert ingredient, e.g. starches or fatty acids. Incorporation of some filler materials can also lead to processing difficulties, and this approach only provides a modest improvement in mildness at best.

Unexpectedly, applicants have found that the use of relatively low levels of specific nonionic polymeric surfactants can be used to obtain these goals. That is, at levels no higher than 25% by wt. of the bar composition, the polymers provide enhanced mildness without sacrificing processability or lather, and have the added benefit of reducing mushing. While not wishing to be bound by theory, it is believed that the copolymers may be interacting with fatty acid soap and anionic surfactant (if present) to form polymer-surfactant complexes.

The use of polyoxyethylene polyoxypropylene (EO-PO) nonionic polymeric surfactants in bar compositions per se is not new.

U.S. Pat. No. 3,312,627 to Hooker, for example, teaches bars substantially free of anionic detergents comprising 0 to 70% by weight EO-PO polymer, polyethylene glycol (PEG) or derivatives of these compounds as base; and 10 to 70% of a nonionic lathering component. In order to give these bars more "soap-like" characteristics, the reference contemplates use of 10%–80% lithium soap. It is clear that use of lithium soap is unique to the invention (column 8, lines 20–23) and that use of other soaps or anionic (other than fatty acid lithium soap) is not contemplated. Thus, this reference clearly differs from the composition of the present invention which comprise 30% to 85% by wt. of a surfactant system of which at least 50% is general fatty acid soaps other than the special lithium soap claimed in the reference. Additionally, the use of lithium soap is excluded from the subject invention.

U.S. Pat. No. 3,766,097 to Rosmarin discloses the use of 30%–50% of a specified EO-PO copolymer (Pluronic F-127) in a bar using sodium cocoyl isethionate (a synthetic surfactant) as primary anionic surfactant. Here again, the polymer is being used as a bar structurant at levels well above the 25% upper limit of the subject invention. There is no teaching or suggestion that the polymers can be used in combination with anionic at much lower levels to unexpectedly and remarkably enhance mildness (e.g., reduce irritation) at these low levels.

U.S. Ser. No. 08/213,287 to Chambers et al. (assigned to Lever Brothers) teaches that certain solid EO-PO polymers can be used as alternatives to solid polyethylene glycols (PEGs) as bar structurants for synthetic bar formulations. Once more, the polymers are contemplated for use as structurants. There is again no teaching or suggestion that the polymers can be used at much lower levels (both as total percentage of compositions and as ratio to total level of anionics) to provide enhanced mildness (i.e., reduced skin irritation).

U.S. Ser. No. 08/616,942 to He et al teaches the use of EO-PO copolymers at levels of 10% by weight and below in a bar composition containing 10 to 70% of synthetic surfactants, which resulted in significant mildness enhancement without sacrificing user properties and processability. This invention did not appreciate that EO-PO copolymers can also be incorporated into bar formulations in which the major surfactant is fatty acid soap to reduce the skin irritation potential without affecting user properties and processability.

In the past, fatty acid soaps have been processed by a technique involving melting-mixing, chipping, and extruding. Often, addition of mildness additives cause adverse processing problems, such as stickiness in extrusion. The applicants have found that the use of levels of EO-PO copolymers up to a level of 25% by weight of the formulation in fatty acid soap based personal cleansing bar formulations (i.e. surfactant is greater than or equal to 50% fatty acid soap) does not cause processing difficulties and can significantly reduce the skin irritation potential.

BRIEF SUMMARY OF THE INVENTION

Applicants have now found that the use of relatively small amounts (e.g. less than or equal to 25%) of specifically defined polyoxyethylene-polyoxypropylene nonionic polymer surfactants in bar compositions comprising primarily fatty acid soap systems remarkably and unexpectedly enhances the mildness of these bars.

More specifically, applicants' invention relates to bar compositions comprising:

(a) 30% to 85% by weight of total composition of fatty acid soaps, preferably 35% to 70% by weight of total composition;

(b) 0 to 30%, preferably 0 to 20% by wt. total composition of a surfactant selected from the group consisting of synthetic anionic surfactant, nonionic surfactant (other than the nonionic polymer surfactant of item (d) below), cationic surfactant, or amphoteric surfactant, and mixtures thereof;

(c) 0% to 40%, preferably 5% to 35% by wt. total composition selected from the group consisting of alkylene oxide components having a molecular weight of from about 2,000 to about 25,000, preferably from about 3000 to about 10000; and $C_8$–$C_{22}$ free fatty acids; $C_2$ to $C_{20}$ alkanols, paraffin waxes; water-soluble starches (e.g. maltodextrin); and (d) 1% to 25%, preferably 3% to 25% by wt. total composition of a polyoxyethylene polyoxypropylene nonionic polymer surfactant (EO-PO polymer) wherein ratio by weight total composition of fatty acid soaps and anionic surfactants to EO-PO polymer is between 1.2:1 to 15:1, preferably 1.5:1 to 9:1;

This range of anionic-soap to EO-PO weight ratio is a criticality because, above this range, the irritation potential of the fatty acid soap can not be effectively mitigated, and below this range, bar user properties, such as lather performance can be negatively affected.

DETAILED DESCRIPTION OF THE INVENTION

Figure 1:
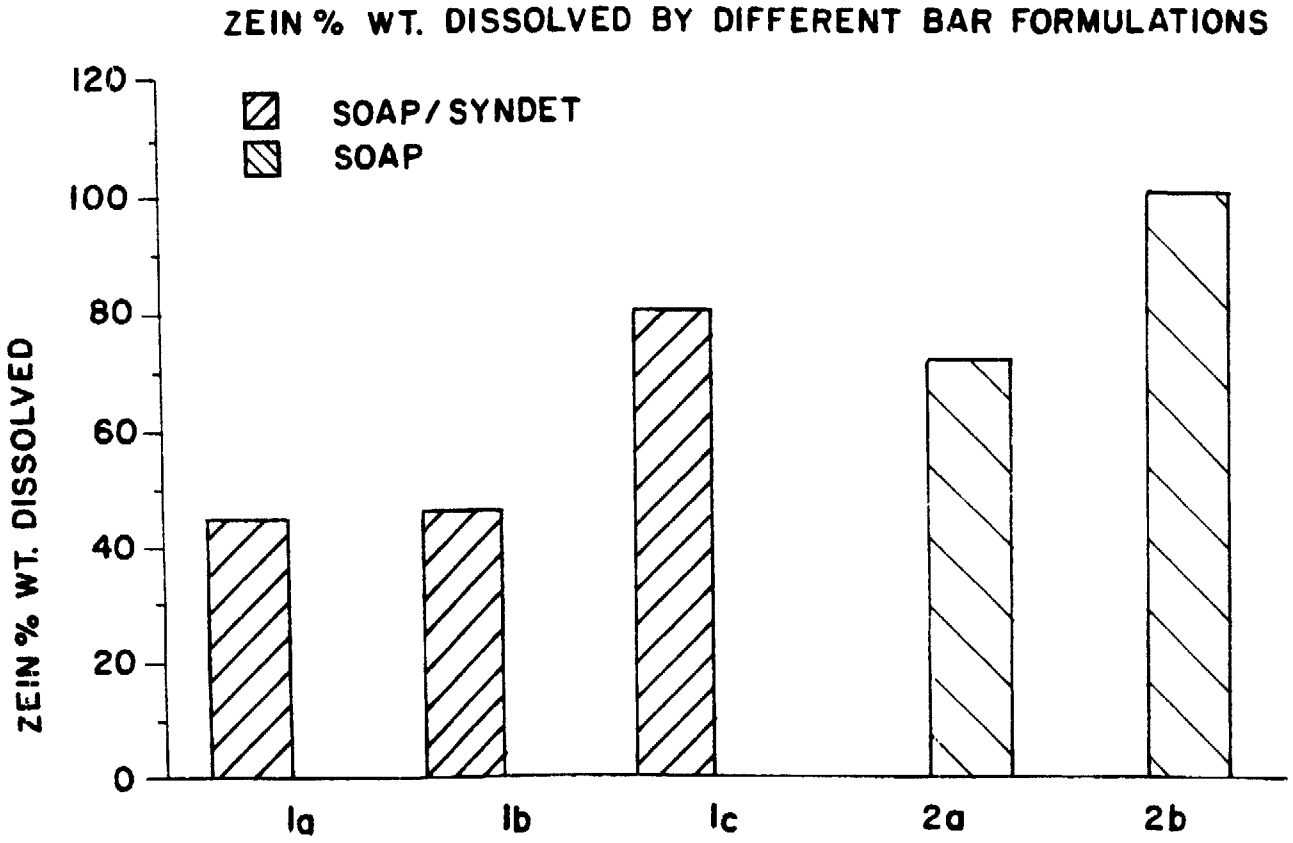
FIG. 1 shows the Zein % dissolved by bars shown in Examples 1a, 1b, and 1c. Bars 1*a* and 1*b*, which include EO-PO copolymer, dissolve a significantly smaller quantity of Zein than Bar 1*c*, which does not contain EO-PO copolymer. Therefore the irritation potential of a fatty acid soap personal washing bar is reduced by including relatively low levels (i.e. 25% wt. and under in a full bar composition) of Pluronics in the bar formulation.

Applicants have now found that the use of relatively small amounts of specifically defined polyoxyethylene-polyoxypropylene nonionic polymer surfactants in bar compositions comprising primarily fatty acid soap systems remarkably and unexpectedly enhances the mildness of these bars.

More specifically, applicants' invention relates to bar compositions comprising:

(a) 30% to 85% by weight of total composition of fatty acid soaps, preferably 35% to 70% by weight of total composition;

(b) 0 to 30%, preferably 0 to 20% by wt. total composition of a synthetic surfactant selected from the group consisting of anionic surfactant, nonionic surfactant (other than the nonionic polymer surfactant of item (d) below), cationic surfactant, or amphoteric surfactant, and mixtures thereof;

(c) 0% to 40%, preferably 5% to 35% by wt. total composition selected from the group consisting of alkylene oxide components having a molecular weight of from about 2,000 to about 25,000, preferably from about 3000 to about 10000; and $C_8$–$C_{22}$ free fatty acids; $C_2$ to $C_{20}$ alkanols, paraffin waxes; water-soluble starches (e.g. maltodextrin); and (d) 1% to 25%, preferably 3% to 25% by wt. total composition of a polyoxyethylene polyoxypropylene nonionic polymer surfactant (EO-PO polymer) wherein ratio by weight total composition of fatty acid soaps and anionic surfactants to EO-PO polymer is between 1.2:1 to 15:1, preferably 1.5:1 to 9:1;

where the range of the anionic-soap to EO-PO weight ratio is a criticality because, above this range, the irritation potential of the fatty acid soap can not be effectively mitigated, and below this range, bar user properties, such as lather performance can be negatively affected.

Soaps

Soaps represent the primary detergent component in the bar compositions of interest. The soaps may have hydrocarbon chain lengths from 10 to 22 and are preferably saturated. The preferred soap is a sodium salt, but other soluble soaps can be used included potassium, ammonium, triethanolammonium, and mixtures thereof. The soaps may be added neat or made in situ by adding a base, e.g., NaOH, to convert free fatty acids. The soaps are preferably prepared by saponification of the corresponding fatty acids.

Synthetic Surfactants

The anionic detergent active which may be used may be aliphatic sulfonates, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glycerol ether sulfonate (AGS); or aromatic sulfonates such as alkyl benzene sulfonate.

The anionic may also be an alkyl sulfate (e.g., $C_{12}$–$C_{18}$ alkyl sulfate) or alkyl ether sulfate (including alkyl glycerol ether sulfates), among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably greater than 3; and M is a solubilizing cation such as sodium, potassium ammonium or substituted ammonium. Ammonium and sodium lauryl ether sulfates are preferred.

The anionic may also be alkyl sulfosuccinates (including mono- and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, alkyl glucosides and acyl isethionates.

Sulfosuccinates may be monoalkyl sulfosuccinates having the formula:

$$R^4O_2CCH_2CH(SO_3M)CO_2M; \text{ and}$$

amide-MEA sulfosuccinates of the formula:

$$R^4CONHCH_2CH_2O_2CCH_2CH(SO_3M)CO_2M$$

wherein $R^4$ ranges from $C_8$–$C_{22}$ alkyl and M is a solubilizing cation.

Sarcosinates are generally indicated by the formula:

$$R^1CON(CH_3)CH_2CO_2M,$$

wherein R ranges from $C_8$–$C_{20}$ alkyl and M is a solubilizing cation.

Taurates are generally identified by formula:

$$R^2CONR^3CH_2CH_2SO_3M$$

wherein $R^2$ ranges from $C_8$–$C_{18}$ alkyl, $R^3$ ranges from $C_1$–$C_4$ a alkyl and M is a solubilizing cation.

Particularly preferred are the $C_8$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 0% to about 30% by weight of the total composition. Preferably, this component is present from about 10% to about 25%.

The acyl isethionate may be an alkoxylated isethionate such as is described in Ilardi et al., U.S. Pat. No. 5,393,466, hereby incorporated by reference. This compound has the general formula:

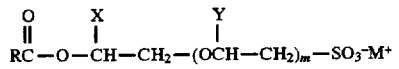

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

The anionic surfactant comprises 0% to 30% of total surfactant system and must comprise no more than 50% of total surfactant system.

Amphoteric detergents which may be used as synthetic surfactants in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula.

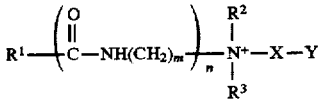

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

m is 2 to 4;

n is 0 to 1;

X is alkylene of 1 to 3 carbon atoms optionally substituted with hydroxyl, and

Y is $—CO_2—$ or $—SO_3—$

Suitable amphoteric detergents within the above general formula include simple betaines of formula:

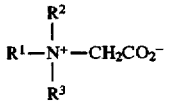

and amido betaines of formula:

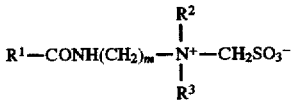

wherein m is 2 or 3.

In both formulae $R^1$, $R^2$, and $R^3$ are as defined previously. $R^1$ may in particular be a mixture of $C_{12}$ and $C_{14}$ alkyl groups derived from coconut so that at least half, preferably at least three quarters of the groups $R^1$ are preferably methyl.

A further possibility is that the amphoteric detergent is a sulphobetaine of formula

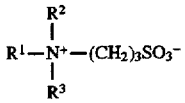

wherein m is 2 or 3, or variants of these in which $—(CH_2)_3SO_3$ is replaced by

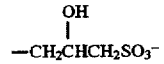

in these formulae $R^1$, $R^2$ and $R^3$ are as discussed previously.

The nonionic which may be used as synthetic surfactants includes in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8C_{18}$) primary or secondary linear or branched alcohols with ethylene oxide, and products made by condensation of ethylene oxide with the reaction products of propylene oxide and ethylenediamene Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Pat. No. 5,389,279 to Au et al. which is hereby incorporated by reference or it may be one of the sugar amides described in U.S. Pat. No. 5,009,814 to Kelkenberg, hereby incorporated into the subject application by reference.

Other surfactants which may be used are described in U.S. Pat. No. 3,723,325 to Parran Jr. which is also incorporated into the subject application by reference.

Nonionic and cationic surfactants which may be used include any one of those described in U.S. Pat. No. 3,761,418 to Parran, Jr. hereby incorporated by reference into the subject application. Those included are the aldobionamides taught in U.S. Pat. No. 5,389,279 to Au et al. and the polyhydroxy fatty acid amides as taught in U.S. Pat. No. 5,312,934 to Letton, both of which are incorporated by reference into the subject application.

The synthetic surfactants generally comprise 10 to 30% of the total composition except, as noted that total synthetic surfactant comprises 50% or less of the surfactant system and no more than 30% total.

A preferred surfactant system is one comprising, in addition to fatty acid soap, acyl isethionate.

Structurant

The structurant of the invention, if used, can be a water soluble or water insoluble structurant.

Water soluble structurants include moderately high molecular weight polyalkylene oxides of appropriate melting point (e.g., 40° to 100° C., preferably 50° to 90°) and in particular polyethylene glycols or mixtures thereof.

Polyethylene glycols (PEG's) which are used may have a molecular weight in the range 2,000 to 25,000, preferably 3,000 to 10,000. However, in some embodiments of this invention it is preferred to include a fairly small quantity of polyethylene glycol with a molecular weight in the range from 50,000 to 500,000, especially molecular weights of around 100,000. Such polyethylene glycols have been found to improve the wear rate of the bars. It is believed that this is because their long polymer chains remain entangled even when the bar composition is wetted during use.

If such high molecular weight polyethylene glycols (or any other water soluble high molecular weight polyalkylene oxides) are used, the quantity is preferably from 1% to 5%, more preferably from 1% or 1.5% to 4% or 4.5% by weight of the composition. These materials will generally be used jointly with a large quantity of other water soluble structurant such as the above mentioned polyethylene glycol of molecular weight 2,000 to 25,000, preferably 3,000 to 10,000.

Water insoluble structurants also have a melting point in the range 40°–100° C., more preferably at least 50° C., notably 50° C. to 90° C. Suitable materials which are particularly envisaged are fatty acids, particularly those having a carbon chain of 12 to 24 carbon atoms. Examples are lauric, myristic, palmitic, stearic, arachidic and behenic acids and mixtures thereof. Sources of these fatty acids are coconut, topped coconut, palm, palm kernel, babassu and tallow fatty acids and partially or fully hardened fatty acids or distilled fatty acids. Other suitable water insoluble structurants include alkanols of 8 to 20 carbon atoms, particularly cetyl alcohol. These materials generally have a water solubility of less than 5 g/litre at 20° C.

The relative proportions of the water soluble structurants and water insoluble structurants govern the rate at which the bar wears during use. The presence of the water-insoluble structurant tends to delay dissolution of the bar when exposed to water during use and hence retard the rate of wear.

The structurant is used in the bar in an amount of 0% to 40%, preferably 5% to 35%.

EO-PO Polymer

The polyoxyethylene polyoxypropylene nonionic copolymers (EO-PO copolymers) of the subject invention are generally commercially available polymers having a broad molecular weight range and EO/PO ratio and a melting temperature of from about 25° to 85° C., preferably 40° to 65° C.

Generally, the polymers will be selected from one of two classes of polymers, i.e., (1) $(EO)_m(PO)_n(EO)_m$ type copolymers or $(PO)_n(EO)_m(PO)_n$ type copolymers of defined m/n ratio and optional hydrophobic moieties (e.g., decyltetradecanol ether) attached to either EO or PO compounds (such products are commercially available for example, from BASF under the Trademark Pluronic® or Pluronic-R®, respectively); or (2) EO-PO polymers with amine constituents such as $N_2C_2H_4(PO)_{4n}(EO)_{4m}$ or $N_2C_2H_4(EO)_{4m}(PO)_{4n}$ with defined values of m and n and optional hydrophobic moieties [for example?] attached to either EO or PO components (such products are commercially available, for example from BASF as Tetronic® and Tetronic-R®, respectively).

Specifically, examples of various Pluronic and Tetronic EO-PO polymers are set forth in Table 1 below wherein $T_m$ (°C.) and Ross Miles foam height data (measured at 0.1% and 50° C.) were digested from literature from BASF.

TABLE 1

| Polymer | | $T_m$(°C.) | Foam Heights (ml) | EO and PO Number m/n |
|---|---|---|---|---|
| Pluronic: | $(EO)_m—(PO)_n—(EO)_m$ | | | |
| | F38 | 48 | 35 | 46/16 |
| | F68 | 52 | 35 | 75/30 |
| | F77 | 48 | 47 | 52/35 |
| | P87 | 49 | 44 | 62/39 |
| | F88 | 54 | 48 | 97/39 |
| | P98 | 58 | 43 | 122/47 |
| | F108 | 57 | 41 | 128/54 |
| | F127 | 56 | 41 | 98/67 |
| Pluronic-R: | $(PO_n—(EO)_m—(PO)_n$ | | | |
| | 10R8 | 46 | 20 | 90/9 |
| | 17R8 | 53 | 2 | 155/15 |
| | 25R8 | 54 | 15 | 227/21 |
| Tetronic: | $N_2C_2H_4—(PO)_{4n}(EO)_{4m}$ | | | |
| | 707 | 46 | 60 | 35/12 |
| | 1107 | 51 | 50 | 64/20 |

TABLE 1-continued

| Polymer | | $T_m$(°C.) | Foam Heights (ml) | EO and PO Number m/n |
|---|---|---|---|---|
| | 908 | 58 | 40 | 85/16 |
| | 1307 | 54 | 40 | 78/25 |
| | 1508 | 60 | 40 | 159/30 |
| Tetronic-R: | $N_2C_2H_4—(EO_{4m}(PO)_{4n}$ | | | |
| | 90R8 | 47 | 0 | 90/17 |
| | 110R7 | 47 | 0 | 64/21 |
| | 150R8 | 53 | 0 | 12/29 |

In general, the molecular weight of the copolymers used ranges from 2,000 to 25,000 (preferably 3,000 to 10,000). The EO-terminated polymers (Pluronic and Tetronic) are preferred to the PO-terminated ones (Pluronic-R and Tetronic-R) for the advantages of mildness enhancement and lather generation. To ensure water solubility, we prefer that the portion of ethylene oxide moiety per mole is between 50% to 90% wt., more preferably 60–85% wt. In other words, 2 m:n (for Pluronic) or m:n (for Tetronic) ranges from 1.32 to 11.9, preferably 2.0 to 7.5.

As noted, melting temperature of the compounds must be about 25°–85°, preferably 40° to 65° C., the latter being more favorable for processing (e.g., chips form more easily and logs plod more readily).

Other Ingredients

Bars of the invention may comprise 0% to 25%, preferably 2% to 15% by wt. of an emollient such as ethylene glycol, propylene glycol and/or glycerine.

Bar compositions of this invention will usually contain water, but the amount of water is only a fairly small proportion of the bar. Larger quantities of water reduce the hardness of the bars. Preferred is that the quantity of water is not over 15% by weight of the bars, preferably 1% to about 10%, more preferably 3% to 9%, most preferably 3% to 8%.

Bars of this invention may optionally include so-called benefit agents—materials included in relatively small proportions which confer some benefit additional to the basic cleansing action of the bars. Examples of such agents are: skin conditioning agents, including emollients such as fatty alcohols and vegetable oils, essential oils, waxes, phospholipids, lanolin, anti-bacterial agents and sanitizers, opacifiers, pearlescers, electrolytes, perfumes, sunscreens, fluorescers and coloring agents. Preferred skin conditioning agents comprise silicone oils, mineral oils and/or glycerol.

The examples below are intended to better illustrate the invention, but are not intended to be limiting in any way.

All percentages, unless otherwise noted, are intended to be percentages by weight.

EXAMPLES

Methodology

Mildness Assessments

Zein dissolution test was used to preliminarily screen the irritation potential of the formulations studied. In an 8 oz. jar, 30 mLs of an aqueous dispersion of a formulation were prepared. The dispersions sat in a 45° C. bath until fully dissolved. Upon equilibration at room temperature, 1.5 gms of zein powder were added to each solution with rapid stirring for one hour. The solutions were then transferred to centrifuge tubes and centrifuged for 30 minutes at approximately 3,000 rpms. The undissolved zein was isolated, rinsed and allowed to dry in a 60° C. vacuum oven to a constant weight. The percent zein solubilized, which is proportional to irritation potential, was determined gravimetrically.

Bar Mush Assessment

Bar mush is determined by placing a bar in a small dish; adding 30 grams of water to the dish; letting the bar soak for 24 hours; and gently scraping the bar with a blunt blade to remove the mush layer. The weight of the mush layer is measured and divided by the initial weight of the bar prior to soaking to obtain a mush weight fraction, $x_m=W_m/W_i$. The final weight of the bar, $W_f$, after the mush layer has been scraped off is also measured. The water uptake weight fraction, $x_u$, can be calculated as $$x_u=(W_m+W_f-W_i)/W_i$$

Three bar samples of a formulation are evaluated in this manner, and the average $x_m$ and $x_u$ are reported here.

Formulation Processing

Bar formulations were prepared in a 5 lb Patterson mixer with a sigma blade. The components were mixed together at ~110° C. The batch was mixed with a cover on to prevent moisture loss for about 20 minutes after all the components had melted, then it was mixed uncovered to dry down to the desired moisture. Total mixing time was approximately 40 minutes. At the final moisture level, the formulation was dropped onto a heated applicator roll and then was chipped over a chill roll. The chill roll chips were plodded under vacuum in a Weber Seelander duplex refiner with screw speed at ~20 rpm. The nose cone of the plodder was heated to 45°–50° C. The cut billets were stamped into bars using a Weber Seelander L4 hydraulic press with a standard bar-shaped die in place.

Examples

Three example formulations, 1a, 1b, and 2a, are provided in Table 2, along with two comparative formulations, 1c and 2b. The comparatives 1c and 2b are essentially representative of a commercial soap/syndet bar and a fatty acid soap bar, respectively. The examples 1a, 1b, and 2a provided rich, creamy and slippery lather; the skin-feel of the bars were found to be smooth and non-tacky; and the processing behavior of the example formulations was acceptable with the similar equipment used to produce the comparatives 1c and 2b.

Mildness assessments of the examples and comparatives were carried out as discussed above by zein solubilization experiments. The results are summarized in FIG. 1. Examples 1a and 1b show greater than 40% reduction in zein solubilization compared to 1c indicating that these formulations are much milder than the comparative. Zein solubilization is also reduced in the fatty soap bar with the EO-PO copolymer, Example 2a, by comparison to 2b.

Mushing behavior of Examples 1a, 1b, and Comparative 1c is presented in Table 3. The soap/syndet comparative has about 40% more mush than the soap/syndet examples which incorporate the EO-PO copolymers.

TABLE 2

| Formulation (expressed in wt %) | 1a | 1b | Comparative 1c | 2a | Comparative 2b |
|---|---|---|---|---|---|
| Sodium Tallowate | 21.3 | 21.3 | 37.3 | 40.1 | 56.1 |
| Sodium Cocoate | 12.0 | 12.0 | 21.0 | 22.5 | 31.5 |
| Sodium acyl isethionate | 14.0 | 14.0 | 14.0 | 0.0 | 0.0 |
| Stearic-palmitic acid | 8.6 | 8.6 | 8.6 | 0.0 | 0.0 |
| Coconut Fatty Acid | 1.4 | 1.4 | 1.4 | 3.9 | 3.9 |
| Pluronic F88* | 25.0 | 5.0 | 0.0 | 25.0 | 0.0 |
| PEG 8000* | 0.0 | 20.0 | 0.0 | 0.0 | 0.0 |

TABLE 2-continued

| Formulation (expressed in wt %) | 1a | 1b | Comparative 1c | 2a | Comparative 2b |
|---|---|---|---|---|---|
| Misc. Salts | 5.4 | 5.4 | 5.4 | 0.0 | 0.0 |
| Other Minor Components** | 0.5 | 0.5 | 0.5 | 0.2 | 0.2 |
| Water | 11.2 | 11.2 | 11.2 | 8.3 | 8.3 |
| Total | 100.0 | 100.0 | 100.0 | 100.0 | 100.0 |

*Pluronic F88; see definition in Table 1.
*PEG 8000: polyoxyethylene glycol with mean molecular weigh at 8000.
**Other minor components include preservatives, perfume, $TiO_2$.

TABLE 3

| | % mush | % water uptake |
|---|---|---|
| 1a | 2.8 | 9.0 |
| 1b | 3.2 | 6.1 |
| 1c | 4.2 | 10.9 |

We claim:

1. A bar composition comprising:

(a) 30% to 85% by weight of total composition of fatty acid soaps;

(b) 0 to 30% by weight of a synthetic surfactant;

(c) 1% to 40% by weight of the composition of a structurant selected from the group consisting of alkylene oxide components having a molecular weight of from about 2,000 to about 25,000; $C_8$–$C_{22}$ free fatty acids; $C_2$ to $C_{20}$ alkanols, paraffin waxes; and water-soluble starches; and (d) 1% to 25% by weight of total composition of an ethylene oxide terminated polyoxyethylene polyoxypropylene nonionic polymer surfactant (EO-PO polymer) having a molecular weight of from about 2,000 to 25,000 and a melting point of about 40° C. to 85° C.;

wherein the portion of ethylene oxide per mole is between 50% to 90%; and wherein the ratio by weight total composition of fatty acid soaps and synthetic surfactants to EO-PO polymer is between 1.2:1 to 15:1.

2. A composition according to claim 1, wherein the surfactant component (b) is selected from the group consisting of anionic surfactant, nonionic surfactant (other than the nonionic polymer surfactant of item 1(d)), cationic surfactant, or amphoteric surfactant, and mixtures thereof.

3. A composition according to claim 1, wherein the fatty acid soaps comprise 35% to 70% by wt. total composition.

4. A composition according to claim 1, wherein the synthetic surfactant of (b) comprises 0% to 20% by wt.

5. A composition according to claim 1, wherein the structurant (c) comprises 5% to 35% by wt.

6. A composition according to claim 1, wherein the molecular weights of alkylene oxide components of structurant (c) range from 3,000 to 10,000.

7. A composition according to claim 1, wherein the EO-PO copolymer (d) comprises 3% to 25% by wt.

8. A composition according to claim 1, wherein the ratio by weight total composition of fatty acid soaps and synthetic surfactant to EO-PO polymer is between 1.5:1 to 9:1.

9. A composition according to claim 2, wherein the synthetic surfactant comprises 0% to 20% by wt.

* * * * *